US005897422A

United States Patent [19]

McGee

[11] Patent Number: 5,897,422

[45] Date of Patent: Apr. 27, 1999

[54] BRASSIERE

[76] Inventor: Marguerite K. McGee, 4719 Cole Ave., Apt. 236, Dallas, Tex. 75205

[21] Appl. No.: 09/078,158

[22] Filed: May 13, 1998

[51] Int. Cl.[6] ..... A41D 3/00

[52] U.S. Cl. ..... 450/58; 2/73; 450/70

[58] Field of Search ..... 2/69, 69.5, 105, 2/106, 113, 114, 115, 73; 450/30, 31, 32, 36, 58, 70, 79, 80, 85

[56] References Cited

U.S. PATENT DOCUMENTS

| | | | |
|---|---|---|---|
| 572,621 | 12/1896 | Stitt . | |
| 1,545,441 | 7/1925 | Newman et al. . | |
| 1,672,770 | 6/1928 | Mountain . | |
| 1,966,174 | 7/1934 | Jones | 450/58 |
| 2,372,855 | 4/1945 | Reid . | |
| 2,402,835 | 6/1946 | Nagy . | |
| 2,706,816 | 4/1955 | Dozier | 450/58 |
| 2,970,597 | 2/1961 | Michel | 450/58 |
| 3,746,007 | 7/1973 | Hand et al. . | |
| 4,741,719 | 5/1988 | Wirth . | |
| 4,821,343 | 4/1989 | Quealy . | |
| 5,180,326 | 1/1993 | Williams | 450/91 |
| 5,378,192 | 1/1995 | Darmante | 450/58 |
| 5,697,830 | 12/1997 | White | 450/36 |

*Primary Examiner*—Jeanette Chapman
*Attorney, Agent, or Firm*—Theodore F. Shiells

[57] ABSTRACT

A sleeping brassiere is provided having a pair of shoulder supports, the shoulder supports extending to a back support, the back support extending from the back toward the front of the wearer and having a portion encircling the wearer and a pair of cup-shaped breast supports. Each of the breast supports has a generally crescent-shaped portion curving generally around the outside and top of the wearer's breast. The crescent-shaped portion has an upper end adjoining the shoulder supports and a lower end adjoining the portion of said back support encircling the wearer at a position generally between and below the breasts of the wearer when the brassiere is worn.

20 Claims, 4 Drawing Sheets

BRASSIERE

FIELD OF THE INVENTION

This invention relates to ladies' brassieres and ladies' garments incorporating a brassiere, and more particularly to a new and improved brassiere that provides improved breast support and comfort during sleep.

PRIOR ART

Brassieres for supporting the breasts and sleeping gowns including support brassieres are well known. Such brassieres are generally designed primarily to support the breasts when the wearer is standing. However, such prior art devices have not been entirely successful in supporting large breasts in a truly comfortable manner when the wearer is lying on her back, side or front during sleep.

OBJECTS OF THE INVENTION

With the foregoing in mind, it is the primary object of the present invention to provide a new and improved brassiere which is designed to support the breasts of the wearer so as to comfortably support the breasts when the wearer is lying on her back, side or front during sleep, while still providing comfortable support when the wearer is standing.

A further object of the present invention is to provide a sleeping gown having a brassiere integral therewith.

Another object of the present invention is to provide a brassiere that supports each breast individually comfortably when the wearer is lying on her back, side or front during sleep, while still providing comfortable support when the wearer is standing.

SUMMARY OF THE INVENTION

In accordance with a preferred embodiment of the invention, the brassiere has a pair of shoulder supports, the shoulder supports extending to a back support, the back support extending from the back toward the front of the wearer and having a portion encircling the wearer. A pair of cup-shaped breast supports are provided, each of the breast supports having a generally crescent-shaped portion curving generally around the outside and top of the wearer's breast, the crescent-shaped portion having an upper end adjoining the shoulder supports and a lower end adjoining the portion of the back support encircling the wearer at a position generally between and below the breasts of the wearer when the brassiere is worn.

In accordance with a preferred aspect of this invention, one of the crescent-shaped portions overlaps the other at its upper portion.

In accordance with another preferred aspect of this invention, the respective crescent-shaped portions are generally non-interconnected at their upper portions so that the cup-shaped breast supports are free to move relatively independently.

In accordance with another preferred aspect of this invention, one of the crescent-shaped portions overlaps the other at its lower portion.

In accordance with another preferred aspect of this invention, the respective crescent-shaped portions are generally non-interconnected at their lower portions so that the cup-shaped breast supports are free to move relatively independently.

In accordance with another preferred aspect of this invention, the cup-shaped breast supports are made of stretchable fabric.

In accordance with another preferred aspect of this invention, the stretchable fabric has a grain which curves generally around the outside of each breast where the cup-shaped breast support meets the back support.

In accordance with another preferred aspect of this invention, each of the cup-shaped breast supports has a crescent-shaped inside edge.

In accordance with another preferred aspect of this invention, the crescent-shaped edges are spaced apart at inside apices thereof to leave an opening between them.

In accordance with another preferred aspect of this invention, one of the crescent-shaped portions overlaps the other at its upper portion.

In accordance with another preferred aspect of this invention, the respective crescent-shaped portions are generally non-interconnected at their upper portions so that the cup-shaped breast supports are free to move relatively independently.

In accordance with another embodiment of the present invention, the brassiere is Incorporated in a sleeping garment, said sleeping garment comprising a dress portion and an integral brassiere portion, the brassiere portion comprising a pair of shoulder supports, the shoulder supports extending to a back support, the back support extending from the back toward the front of the wearer and having a portion encircling the wearer. The brassiere portion further has a pair of cup-shaped breast supports, each of the breast supports having a generally crescent-shaped portion curving generally around the outside and top of the wearer's breast, the crescent-shaped portion having an upper end adjoining the shoulder supports and a lower end adjoining the portion of the back support encircling the wearer at a position generally between and below the breasts of the wearer when the brassiere is worn.

The foregoing and additional objects and advantages of the present invention will be readily apparent and better understood from the following description, taken in conjunction with the accompanying drawing, in which:

DETAILED DESCRIPTION

Figure 1:
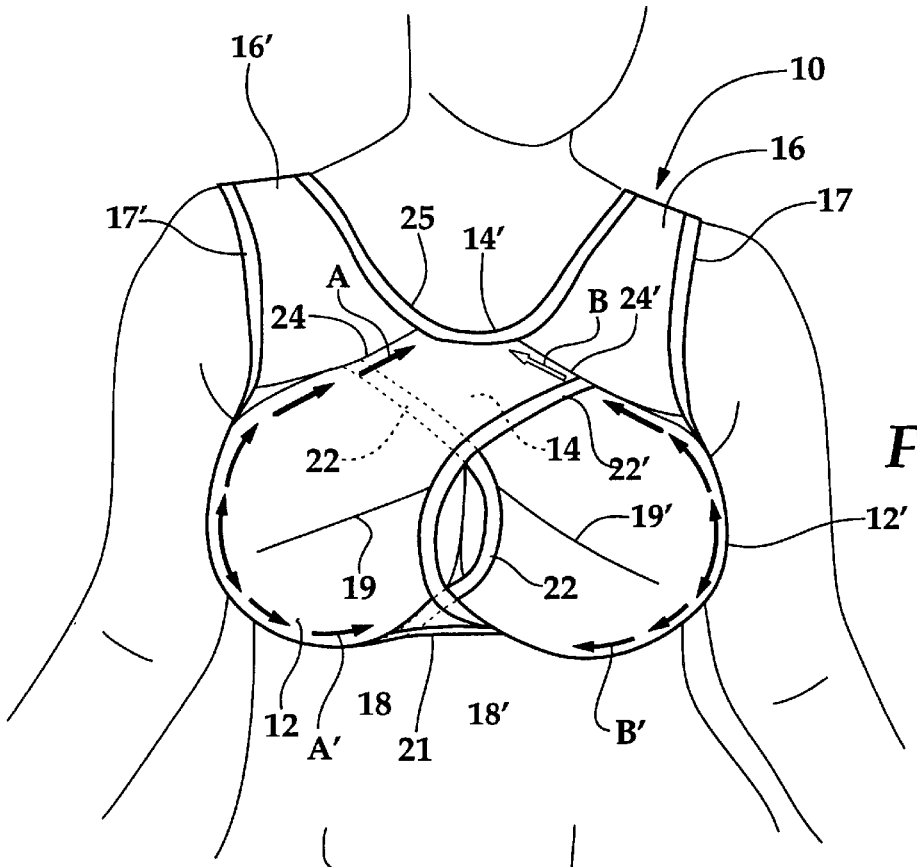
FIG. 1 is a front view of the brassiere of the present invention illustrating many of the parts thereof, with the wearer on her back, and showing primary stress flow patterns.
Figure 2:
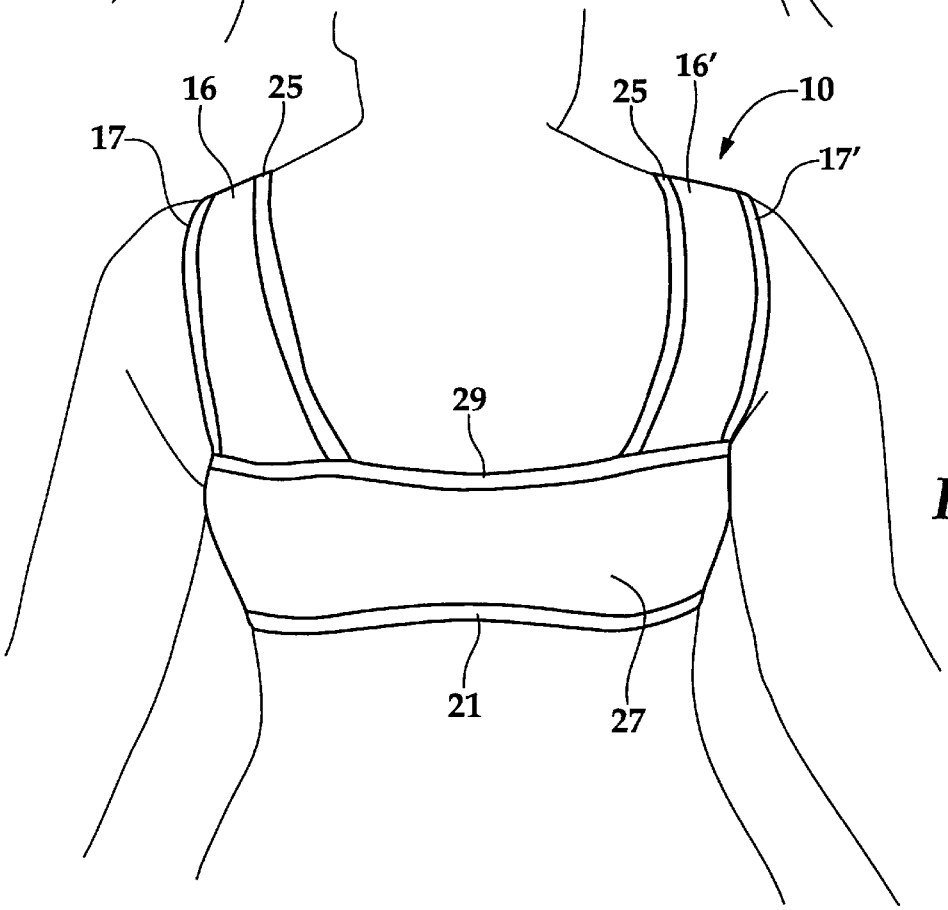
FIG. 2 is a rear view of the brassiere constructed in accordance with the present invention depicted in FIG. 1, with the wearer on her front.

With reference to the drawings in detail, and initially to FIGS. 1–2 thereof, a brassiere in accordance with a preferred embodiment of the invention, as worn by a wearer lying on her back, is shown generally as 10.

Brassiere 10 includes two breast-shaped cups 12 and 12', which are preferably substantially identical. Cups 12 and 12' include respective upper attachment portions 14 and 14' for attaching and supporting the cups from respective shoulder supports 16 and 16', and lower attachment portions 18 and 18' for attaching and securing the cups at their lower portions to a lower midriff edge 21 of a portion of back support 27 that encircles the wearer, at a generally middle position between the lower half of the cups. Shoulder supports 16 and 16' preferably include anterior edges 17 and 17' encircling the shoulder of the wearer. However, alternatively, the shoulder supports for the brassiere may constructed in the manner of a sleeves for a jersey. In This case, the shoulder supports would terminate in a short or long sleeve instead of terminating at edges 17 and 17'.

In FIG. 2, the brassiere 10 depicted in FIG. 1 is depicted, with the wearer lying on her front. Brassiere 10 includes the back portions of shoulder supports 16 and 16', which connect at their lower ends to a back strap 27 in a generally conventional manner. Back strap 27 has an upper edge 29 which extends around to connect to generally upper portion of each of the cups 12 and 12', also in a generally conventional manner. As noted above, however, the support for the brassiere may constructed in the manner of a jersey. In this case, the back strap 27 and shoulder supports 16 and 16' would be essentially one piece, in the manner of a jersey.

Turning again to FIG. 1, cups 12 and 12' each preferably include a generally crescent-shaped edge 22 and 22' around its inside, near the middle of the wearer, and leading to upper attachments portions 16 and 16' and lower attachment portions 18 and 18' curving over and under the breast supported by the cup. The upper and lower attachment portions 16 and 18 of cup 12 preferably overlap with upper and lower attachment portions 16' and 18'. Edges 22' and 18 are depicted with dotted lines to show that they are underneath the respective upper and lower portion of the opposite cup. Cups 12 and 12' also preferably includes respective darts 19 and 19', to facilitate providing a cup-like shape to each.

Preferably, the edges 22 and 22' and upper attachment portions 14 and 14' are generally non-interconnected where they cross or overlap (except where they meet at connections or seams 24, 24' and neck edge 25). Similarly, preferably, the lower attachment portions 16 and 16' are preferably non-interconnected to each other except at connections or seams 20 and 20' (visible in FIGS. 5 and 6, but not FIGS. 1–4) near lower edge 21. This permits cups 12 and 12' to move substantially independently, increasing the comfort of the wearer. If convenient, however, any of he edges 22, 22', attachment portions 14 and 14' and/or attachment portions 16 and 16' may be interconnected, with some loss in the independent movement of cups 12 and 12'. Of course, although connections or seams 24 and 24' are shown, it is not necessary that there be a seam, since the parts could be one piece at this junction, or may have only a stitch line at this position.

When brassiere 10 is worn by the wearer lying down on her back, as depicted in FIG. 1, cup 12 is supported by forces on upper attachment portion 14' in generally the direction of arrow A and cup 12' is supported by forces on upper attachment portion 14 in generally the direction of arrow B (i.e., curving from the outside of the breast, over the top of the breast to attachment portion 14'), where they attach to respective shoulder supports 16 and 16' at their respective connections or seams 24 and 24'. In addition, cups 12 and 12' are supported by lower attachment forces A' and B', which curve in a similar, but oppositely directed manner, from the outside of the breast, underneath the breast, to edge 21 (i.e., generally curving downwardly and inwardly). Preferably, generally similar and parallel forces (not shown) are present on or near edges 22 and 22' to help generally support the breasts toward the middle of the wearer from the inside of the cups 12 and 12'. All these inwardly curving forces A, A' and B, B' (and the parallel forces on or near the inside edges 22 and 22') tend to keep the breasts centered on the chest of the wearer, preventing the breasts from uncomfortably sagging over the sides of the wearer's chest due to the pull of gravity.

Brassiere 10 is preferably made of a stretchable fabric, such as a knit fabric. Cotton and cotton blends, such as a 90% cotton/10% Lycra blend, are preferred fabrics. But other stretchable, or non-stretchable, fabrics can be employed. If stretchable fabric is employed, preferably, the brassiere 10 is constructed so that the stretchable grain of the fabric is curved on the outside portion of each cup, along the path of the arrows A, A' and B, B'. This facilitates the comfortable side support provided by each cup.

Figure 3:
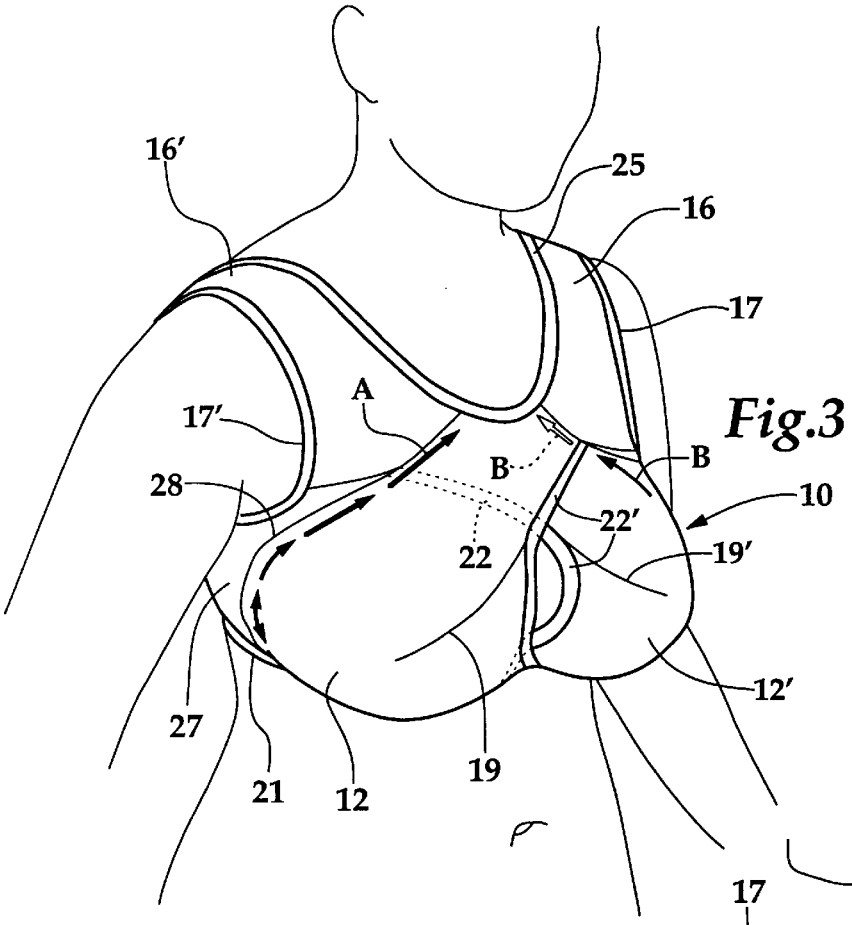
FIG. 3 is a perspective view of the brassiere of the present invention, shown at an angle to the right front of the wearer, when the brassiere is worn upright, and showing primary stress flow patterns.
Figure 4:
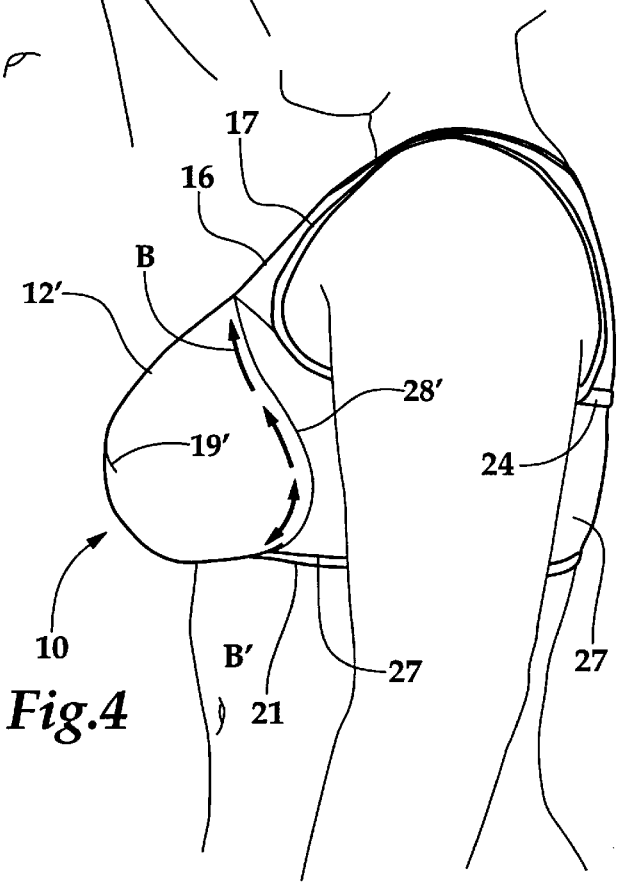
FIG. 4 is a left-side view of the brassiere of the present invention, worn upright, and showing primary stress flow patterns.

FIGS. 3 and 4 depict the brassiere 10 worn while the wearer is standing. Cups 12 and 12' are connected to back strap 27 at connections or seams 28 and 28' respectively. Cup 12 is supported by forces on upper attachment portion 14' in generally the direction of arrow A and cup 12' is supported by forces on upper attachment portion 14 in generally the direction of arrow B (i.e., curving from the outside of the breast, over the top of the breast to attachment portions 14 or 14'), where they attach to respective shoulder supports 16 and 16' at their respective connections or seams 24 and 24'. The attachment forces A' and B' similarly curve from the outside of the breast, underneath the breast, to edge 21 (i.e., generally curving downwardly and inwardly). Preferably, generally similar and parallel forces are present on or near edges 22 and 22' to help generally support the breasts on the inside. Of course, because the wearer is upright, most of support is provided by forces A and B generally around the outside of the breasts and upward, rather than being more evenly shared with downward forces A' and B', as is the case in FIG. 1 described above.

Figure 5:
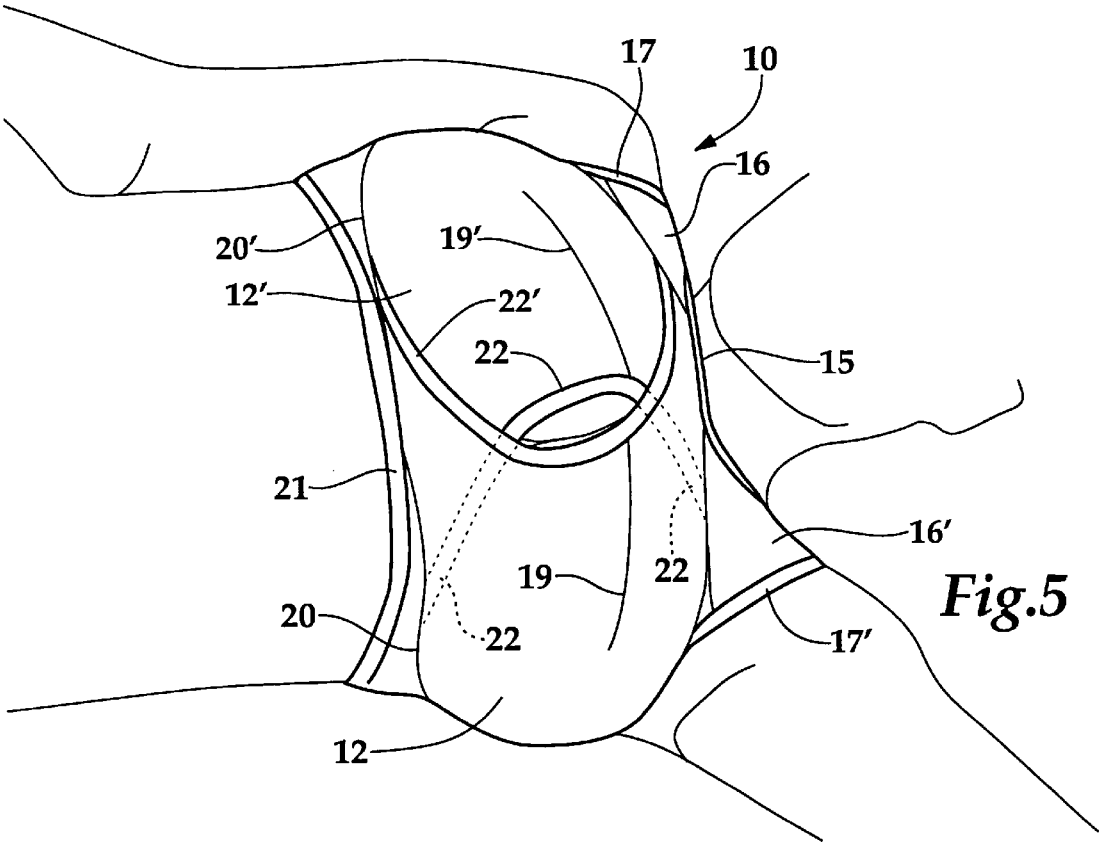
FIG. 5 is a side-underneath view of the brassiere of the present invention, when the brassiere is worn while the wearer is reclining on her left side.
Figure 6:
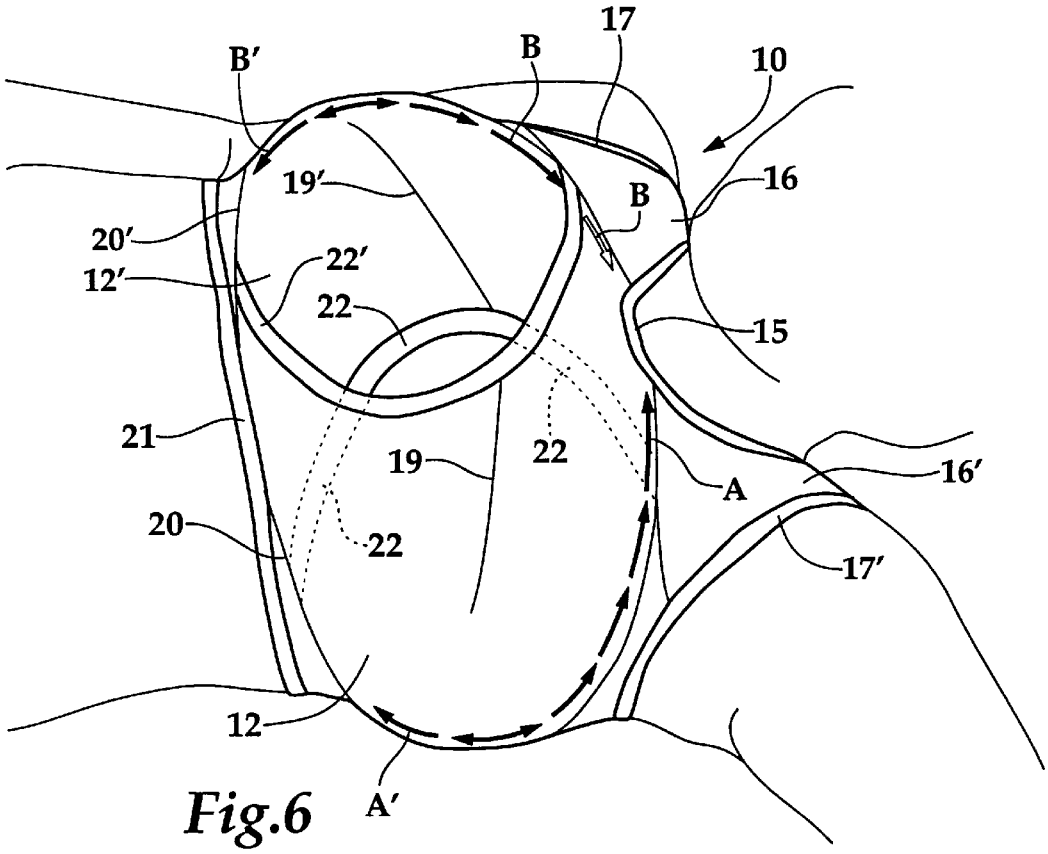
FIG. 6 is a side view of the brassiere of the present invention, when the brassiere is worn while the wearer is reclining on her left side in a slightly different position than shown in FIG. 5, and showing primary stress flow patterns.

FIGS. 5 and 6 depict the brassiere 10 worn when the wearer is lying on her left side The left breast is generally supported by the right shoulder and the right half of the chest and the right breast is generally supported by the left shoulder and left half of the chest. The attachment and support forces are depicted as arrows A, A', B and B' and generally and gently pull each breast toward the middle of the wearer. As can be seen by comparing FIG. 6 (which depicts the brassiere with the wearer in a slightly different position from FIG. 5) each of cups 12 and 12' are slightly displaced from the position shown in FIG. 5, owing to the generally independently movable cups.

FIG. 6 depicts the front of brassiere 10 worn by the wearer when the wearer is on her side, in a slightly different position from that shown in FIG. 1, and shows the primary support forces. In this position, forces A, A' on the right breast in cup 12 tend mostly to hold the breast down to the chest of the wearer, and the forces on or near edge 22 of cup 12' tend to hold the right breast upwardly (toward the wearer's right side) against the force of gravity. The left breast is supported generally in the manner described above with respect to FIG. 1 except, of course, that the left breast may also be supported to some extent directly by the sleeping surface (not shown).

Figure 7:
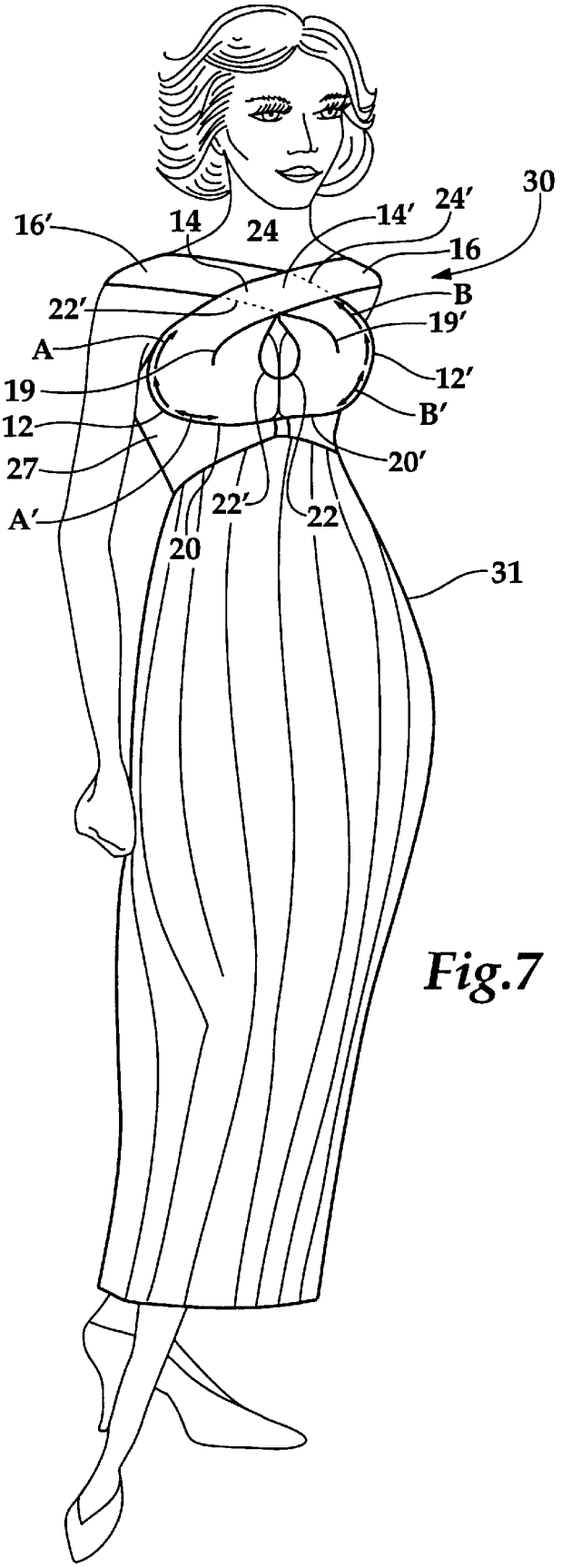
FIG. 7 is a side view of a sleeping gown incorporating a brassiere in accordance with the present invention, when the brassiere is worn while the wearer is standing, and showing primary stress flow patterns.

FIG. 7 depicts a sleeping gown 30 incorporating a dress portion 31 connected to an integral brassiere 10'. Brassiere 10' is similar to brassiere 10 except that upper support portions 14 and 14' are integral with shoulder supports 16 and 16', cup-shaped breast supports 12 and 12' are interconnected at their lower portions, between the lower portion of the breasts of the wearer, and the back strap 27 is wider at the midriff. Overlapping upper support portions 14 and 14' are preferably connected at stitch lines 24 and 24' to provide greater stability for the garment. However, to provide for independent movement of cups 12 and 12', upper support portions are preferably (though not necessarily) non-interconnected at stitch lines 22 and 22'. Of course, brassiere 10' may be made in exactly the same manner as brassier 10, if desired, or with any variation in keeping with the present invention.

In accordance with the present invention, the breasts are supported gently yet firmly inwardly, primarily from the outside of the breasts. There is no uncomfortably great inward pressure holding the breast against the chest of the wearer to distort same from their naturally intended form, nor is there any pressure sufficient to cause reduced blood circulation in the area of the breast regardless of the position of the wearer. Use of the present invention will provide better support for the breasts and greater comfort during sleep and assist the wearer in obtaining and keeping a healthy bust tissue, eliminating particularly the side wise sag of the breasts as commonly encountered by heavy-breasted women not having support mechanisms when they sleep.

While particular embodiments of the present invention have been described and shown, the said invention is not intended to be restricted to any particular construction or arrangement, or to specific embodiments disclosed herein, or any specific method or operation or use, since the same may be modified in various particulars, without departing from the spirit or scope of the invention herein shown, the scope of which is set forth in the claims.

What is claimed is:

1. A brassiere comprising a pair of shoulder supports, said shoulder supports extending to a back support, said back support extending from the back toward the front of the wearer and having a portion encircling the wearer, a pair of cup-shaped breast supports, each of said breast supports having a generally crescent-shaped portion curving generally around the outside and top of the wearer's breast, said crescent-shaped portion having an upper end extending over the top portion of the wearer's breast and adjoined to a diagonally opposite one of said shoulder supports and a lower end adjoining said portion of said back support encircling the wearer at a position generally between and below the breasts of the wearer when the brassiere is worn.

2. The brassiere defined in claim 1, wherein one of said crescent-shaped portions overlaps the other at its upper portion.

3. The brassiere defined in claim 2, wherein the respective crescent-shaped portions are generally non-interconnected at their upper portions so that the cup-shaped breast supports are free to move relatively independently.

4. The brassiere defined in claim 1, wherein one of said crescent-shaped portions overlaps the other at its lower portion.

5. The brassiere defined in claim 4, wherein the respective crescent-shaped portions are generally non-interconnected at their lower portions so that the cup-shaped breast supports are free to move relatively independently.

6. The brassiere defined in claim 1, wherein said cup-shaped breast supports are made of stretchable fabric.

7. The brassiere defined in claim 6, wherein said stretchable fabric has a grain which curves generally around the outside of each breast where said cup-shaped breast support meets said back support.

8. The brassiere defined in claim 1, wherein each of said cup-shaped breast supports has a crescent-shaped inside edge.

9. The brassiere defined in claim 8, wherein said crescent-shaped edges are spaced apart at inside apices thereof to leave an opening between them.

10. The brassiere defined in claim 9, wherein one of said crescent-shaped portions overlaps the other at its upper portion.

11. The brassiere defined in claim 10, wherein the respective crescent-shaped portions are generally non-interconnected at their upper portions so that the cup-shaped breast supports are free to move relatively independently.

12. A sleeping garment comprising an integral brassiere, said brassiere comprising:

a pair of shoulder supports, said shoulder supports extending to a back support, said back support extending from the back toward the front of the wearer and having a portion encircling the wearer, a pair of cup-shaped breast supports, each of said breast supports having a generally crescent-shaped portion curving generally around the outside and top of the wearer's breast, said crescent-shaped portion having an upper end extending over the top portionof the wearer's breast and adjoined to a diagonally opposite one of said shoulder supports and a lower end adjoining said portion of said back support encircling the wearer at a position generally between and below the breasts of the wearer when the brassiere is worn.

13. The sleeping garment defined in claim 12, wherein one of said crescent-shaped portions overlaps the other at its upper portion.

14. The sleeping garment defined in claim 13, wherein the respective crescent-shaped portions are generally non-interconnected at their upper portions so that the cup-shaped breast supports are free to move relatively independently.

15. The sleeping garment defined in claim 12, wherein said cup-shaped breast supports are made of stretchable fabric.

16. The sleeping garment defined in claim 15, wherein said stretchable fabric has a grain which curves generally around the outside of each breast where said cup-shaped breast support meets said back support.

17. The sleeping garment defined in claim 12, wherein each of said cup-shaped breast supports has a crescent-shaped inside edge.

18. The sleeping garment defined in claim 17, wherein said crescent-shaped edges are spaced apart at inside apices thereof to leave an opening between them.

19. The sleeping garment defined in claim 18, wherein one of said crescent-shaped portions overlaps the other at its upper portion.

20. The sleeping garment defined in claim 19, wherein the respective crescent-shaped portions are generally non-interconnected at their upper portions so that the cup-shaped breast supports are free to move relatively independently.

* * * * *